US009460874B2

(12) United States Patent
Kantas

(10) Patent No.: US 9,460,874 B2
(45) Date of Patent: Oct. 4, 2016

(54) ARC CONTROL DEVICE FOR VACUUM BULB

(71) Applicant: SCHNEIDER ELECTRIC INDUSTRIES SAS, Rueil Malmaison (FR)

(72) Inventor: Said Kantas, Montpellier (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/400,436

(22) PCT Filed: May 17, 2013

(86) PCT No.: PCT/FR2013/051091
§ 371 (c)(1),
(2) Date: Nov. 11, 2014

(87) PCT Pub. No.: WO2013/175112
PCT Pub. Date: Nov. 28, 2013

(65) Prior Publication Data

US 2015/0162151 A1 Jun. 11, 2015

(30) Foreign Application Priority Data

May 24, 2012 (FR) ..... 12 01483

(51) Int. Cl.
*H01H 33/664* (2006.01)

(52) U.S. Cl.
CPC ..... *H01H 33/6643* (2013.01); *H01H 33/6644* (2013.01)

(58) Field of Classification Search
CPC ..... H01H 33/6642; H01H 33/6643; H01H 33/6644; H01H 1/06
See application file for complete search history.

(56) References Cited

U.S. PATENT DOCUMENTS

| | | | | |
|---|---|---|---|---|
| 4,210,790 | A * | 7/1980 | Kurosawa | H01H 33/6644 218/127 |
| 4,695,689 | A * | 9/1987 | Kurosawa | H01H 33/664 218/128 |
| 5,495,085 | A | 2/1996 | Yorita et al. | |
| 5,597,993 | A | 1/1997 | Yorita et al. | |
| 5,646,386 | A | 7/1997 | Yorita et al. | |
| 5,763,848 | A * | 6/1998 | Hakamata | H01H 33/6643 218/128 |
| 5,777,287 | A * | 7/1998 | Mayo | H01H 33/6642 200/275 |
| 6,072,141 | A * | 6/2000 | Slamecka | H01H 33/664 218/123 |

(Continued)

FOREIGN PATENT DOCUMENTS

| | | |
|---|---|---|
| DE | 37 24 813 | 2/1989 |
| EP | 0 597 434 | 5/1994 |

(Continued)

OTHER PUBLICATIONS

International Search Report Issued Sep. 10, 2013 in PCT/FR13/051091 Filed May 17, 2013.

*Primary Examiner* — Truc Nguyen
(74) *Attorney, Agent, or Firm* — Oblon, McClelland, Maier & Neustadt, L.L.P.

(57) ABSTRACT

To control the arc that forms during cut-off in a vacuum bulb, a contact device makes it possible to inflict a rotational motion on the arc, while keeping the arc diffuse. The rotating diffuse arc is obtained with each of two electrodes of the contact device including a solid wafer associated with a base of petal type, the two electrodes mirroring one another.

17 Claims, 6 Drawing Sheets

(56) References Cited

U.S. PATENT DOCUMENTS

| | | | | |
|---|---|---|---|---|
| 2002/0043514 | A1* | 4/2002 | Kim, II | H01H 33/6644 218/118 |
| 2002/0166841 | A1* | 11/2002 | Takebuchi | H01H 33/6642 218/123 |
| 2003/0015500 | A1* | 1/2003 | Asakawa | H01H 33/664 218/123 |
| 2006/0124600 | A1 | 6/2006 | Harada et al. | |
| 2008/0067151 | A1 | 3/2008 | Steffens et al. | |
| 2011/0073566 | A1* | 3/2011 | Kantas | H01H 33/6642 218/30 |
| 2012/0091102 | A1* | 4/2012 | Kim | H01H 33/6643 218/128 |
| 2013/0213939 | A1 | 8/2013 | Gentsch et al. | |
| 2015/0248978 | A1* | 9/2015 | Gentsch | H01H 33/6642 218/128 |

FOREIGN PATENT DOCUMENTS

| | | |
|---|---|---|
| FR | 2 541 038 | 8/1984 |
| WO | 01 41173 | 6/2001 |
| WO | 2012 038092 | 3/2012 |

* cited by examiner

ARC CONTROL DEVICE FOR VACUUM BULB

TECHNICAL FIELD

The invention relates to a device with two contacts that are mobile relative to one another, in particular used for vacuum bulbs, allowing the arc that can form to be controlled by forcing its path while at the same time diffusing it. Notably, the superposable electrodes comprise a tablet-shaped element coupled to a base element comprising slots and fittings.

The invention also relates to a medium voltage bulb and to an electrical switchgear installation implementing the type of arc control developed by the contact device.

STATE OF THE ART

Medium voltage electrical distribution installations, notably between 12 and 72 kV, can use vacuum bulbs which must then handle the continuous flow of current, typically of the order of 1250 A to 10 kA, without undergoing excessive heating, and must disconnect short-circuit currents of the order of a few thousands of amps, typically from 25 kA to 100 kA. The vacuum bulbs thus comprise two electrodes that are mobile relative to one another, which are in contact for the passage of a nominal current and are separated to interrupt it.

The current disconnection can lead to the appearance of an electrical arc which needs to be controlled and dissipated as fast as possible. The arc control can thus be of the type using an axial magnetic field, or AMF, or using a radial or transverse magnetic field, i.e. RMF or TMF: see FIG. 1.

In an arc control of the RMF or TMF type, the arc 1 is concentrated, contracted, into a column which typically has a diameter of around 1 cm. By virtue of the radial or transverse magnetic field created by the flow of the current within the contacts 3, this arc 1 executes a rotational movement along the periphery of the two contacts 3 and its thermal energy gets distributed over a wide surface area. In order to create the magnetic field, numerous shapes of contact 3 have been developed, notably based on models of the "cup" type 3A (see DE 372 48 13 or FIG. 1A) for the RMF or of the "petal" type 3B (see FR 2 541 038 or FIG. 1B) for the TMF. These controls offer a good current disconnection efficiency and a good performance with long arc times (longer than 15 ms), while withstanding well the effect of current loops created by the connection bars of the vacuum bulbs in circuit breakers and cells. However, the rotating arcs lead to an excessive erosion of the contacts (together with the filling in of the gap between petals 3B where they exist) and hence the electrical longevity of the device is moderate; moreover, the dielectric breakdown performance remains average, in particular after fault current disconnections.

In an AMF control, the arc 5 is maintained diffuse, in other words composed of several arc columns that are more or less parallel, in order to minimize the thermal energy density on the surface of the two contacts 7 until the current falls naturally to zero and is interrupted: FIG. 1C. The relatively uniform distribution of the energy of the arc 5 offers a very low rate of erosion. However, although the arc 5 can be maintained relatively diffuse for given r.m.s. current values, in certain phases of the current wave, notably when the instantaneous current is very high and during strong asymmetries, the given parameters do not allow this arc 5 to be fully diffused, and a main column, surrounded by a halo, may be generated. Since the thermal load is no longer uniformly distributed, a non-disconnection can occur; moreover, when shutting down a fault current, welds can form between the two surfaces of the contacts 7. Cut-outs on or under the surface of the contacts in order to solve these problems have been provided (WO 2001/41173), which leads to a reduction in the dielectric performance characteristics, while at the same time not completely solving the problems. One example of axial control is also described in US 2006/124600: in this instance, two identical electrodes are placed facing each other.

In order to take advantage of the two types of control, certain systems have been developed combining the two actions: see for example WO 2012/038092 or US 2008/67151 which use contacts comprising a central part of the TMF type and a peripheral part of the AMF type. However, aside from the fact that these contacts are expensive, the result obtained remains a compromise and conserves the weak points of the two previous types. Notably, the erosion of the contacts caused by the RMF control remains, together with the filling in of the gap between the petals. Moreover, if the initial arc starts on the peripheral part, only the axial control remains, with no influence of the radial control handled by the central part of the contact.

SUMMARY OF THE INVENTION

The invention thus aims to provide a mixed control of the arc generated upon disconnection by a novel contact device, based on the fact that the force which is responsible for the diffusion of the arc is of a different nature from the force giving it a rotational movement.

The invention thus relates to a device comprising two contact electrodes notably for a medium voltage vacuum bulb. The two electrodes of the device are mirror images of each other, and each mounted on a shaft: in the closed position, one surface of each electrode is in contact with the other; in the open position, a translation along at least one of the shafts has been applied, and the two surfaces are separated from one another while remaining parallel.

Each electrode comprises a tablet-shaped contact associated with a base element. The two solid wafers are superposable on the circular contact surface of the electrode. Advantageously, the tablet-shaped elements take the form of flat full disks and are made of a material adapted to the presence of an arc, notably an alloy of copper.

On its surface opposite to the contact surface, the solid wafer is coupled to a base element, preferably by brazing. The coupling surface of the base element is circular, with a diameter less than or equal to the diameter of the tablet-shaped element; fixtures may be provided, for example a groove associated with a lip of the tablet-shaped element.

The base element can take the form of a disk, or of a bowl, made of conducting material, preferably of copper; advantageously, its external shape does not comprise any sharp angles, with the possible exception of the coupling surface. The base can be hollowed out at its center, such that the tablet-shaped element is only rigidly fixed against it on a peripheral edge; a metal reinforcement can then be installed at the center of the hollow in order to reinforce the structure.

The base comprises a plurality of cut-outs, slots or grooves, which allow the path of the lines of current flowing in it to be determined, which forms the basis of the diffusion phenomenon of the arc. In particular, the base comprises at least three, preferably five, through-slots between the coupling face and the opposite face, which separate the base into sectors. The slots extend between a first peripheral end, which may open out from the base or otherwise, and a second end internal to the base, toward its center; at their internal end, the slots are tangential to a circle concentric with the shaft. The slots may be rectilinear or curved; preferably, all the slots are superposable with one other, and spaced out from one another by a constant angle in such a manner that the sectors are identical.

In order to even better direct the lines of current, it may be advantageous to also provide recesses in the lip used for the rigid attachment to the tablet-shaped element. In particular, it may be advantageous for the central hollow of the base to be extended within each sector, so as to form for example a coupling surface comprising uniformly distributed ring sectors, bounded on one side by one of the cut-outs. Alternatively or as a complement, the rigid fixing part of the base can have an adapted non-circular shape, for example with a star-shaped central hollow.

The invention also relates to a vacuum bulb comprising a device such as previously defined associated with means of displacement of at least one of the shafts. The invention lastly relates to a medium voltage switchgear unit in which the contact device allows two lines, or parts of a line, of an electrical power system to be separated or a unit of electrical equipment of the power system, notably an alternator, to be isolated.

BRIEF DESCRIPTION OF THE FIGURES

Other advantages and features will become more clearly apparent from the description that follows of particular embodiments of the invention, given by way of non-limiting illustrations, shown in the appended figures.

DETAILED DESCRIPTION OF ONE PREFERRED EMBODIMENT

As described hereinabove, in the existing types of arc control, the magnetic force of a radial or transverse field makes the arc rotate but allows it to contract, whereas the magnetic force of the axial field allows the arc to be maintained as diffuse as possible over a certain surface area of the contacts without changing the arc region. These two options allow the energy of the arc to be dissipated.

According to the invention, the energy of the arc which is formed upon the separation of the contacts in the vacuum bulb is distributed in such a manner as to be able to hold the transient re-initiation voltage TRV which appears between the terminals of the bulb immediately after the extinction of the arc at the moment when the current goes through its natural zero, said distribution being applied according to another principle than in the prior art, by looking for the origin of one of the two forces, between the force allowing the arc to be rotated and that allowing it to be diffused, elsewhere than within the magnetic field. In particular:

- the effect of rotation of the arc is obtained by the radial magnetic field created by the overall movement of the current within the structure of the electrode of the contact device;
- the effect of diffusion of the arc is obtained by forcing the lines of current to follow defined paths with a high current density when it penetrates into the electrode of the contact device;
- then, a lower current density at the moment when the lines of current penetrate the part which forms the surface of the contact, so as to pass into the arc and into the second electrode.

Figure 1C:
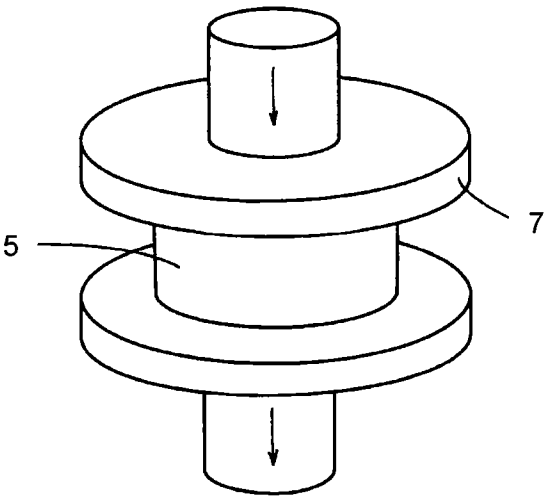
FIGS. 1A, 1B and 1C, already described, illustrate the principle of operation of the contact devices according to the prior art.
Figure 1B:
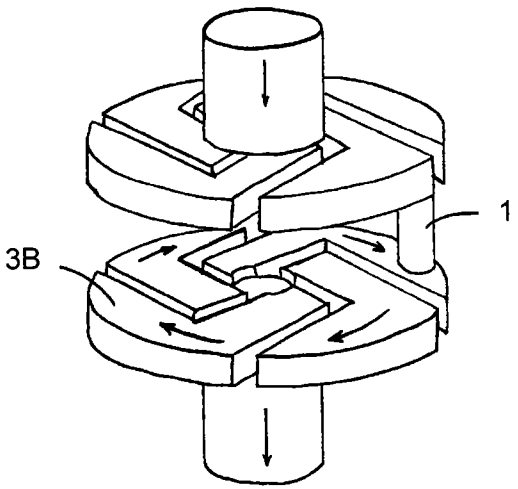
Figure 1A:
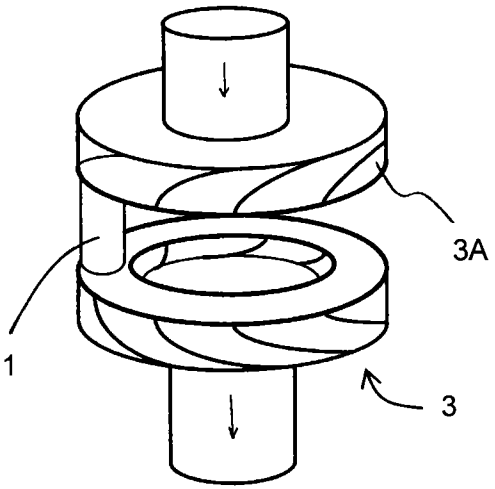
Figure 2A:
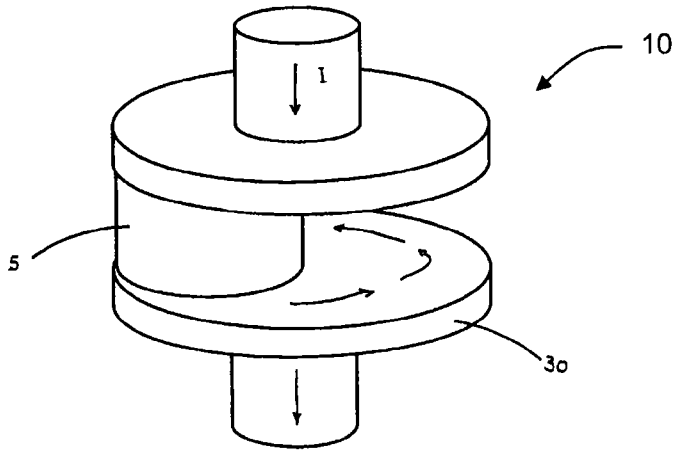
FIG. 2A illustrates the principle of operation of the contact device according to one embodiment of the invention.

In fact, the arc 9 is diffused as with an axial arc control AMF, but undergoes a rotational movement as in TMF/RMF mode, this being however over the whole surface of the contacts, including the center of the latter: see FIG. 2A. This type of arc control therefore offers a better disconnection rating than the axial control while at the same time maintaining a very low level of erosion.

Notably, the contacts between which the arc is produced are formed in two parts, a support for distribution of the lines of current and for acceleration in rotation of the arc then a contact surface on which the arc burns. The path of the current is defined by the shape of cut-outs in the support, which may be straight or curved in order to define the spiral effect, and to the fact that the two contacts are mirror images of each other, in other words non-superposable.

In particular, the diffusion of the arc formed in the support is ensured by the fact that the lines of current naturally occupy the whole volume available when they pass through the base element: going from the center toward the periphery, the lines of current see the volume through which they pass widening, and hence they are dispersed. On the anode, the same phenomenon occurs in the reverse direction: the lines of current enter into the anode via the widest part and are therefore dispersed in the arc, which gives the latter its relatively diffuse aspect; then, the lines of current are directed toward the center of the base where they converge, far from the arc.

Figure 2D:
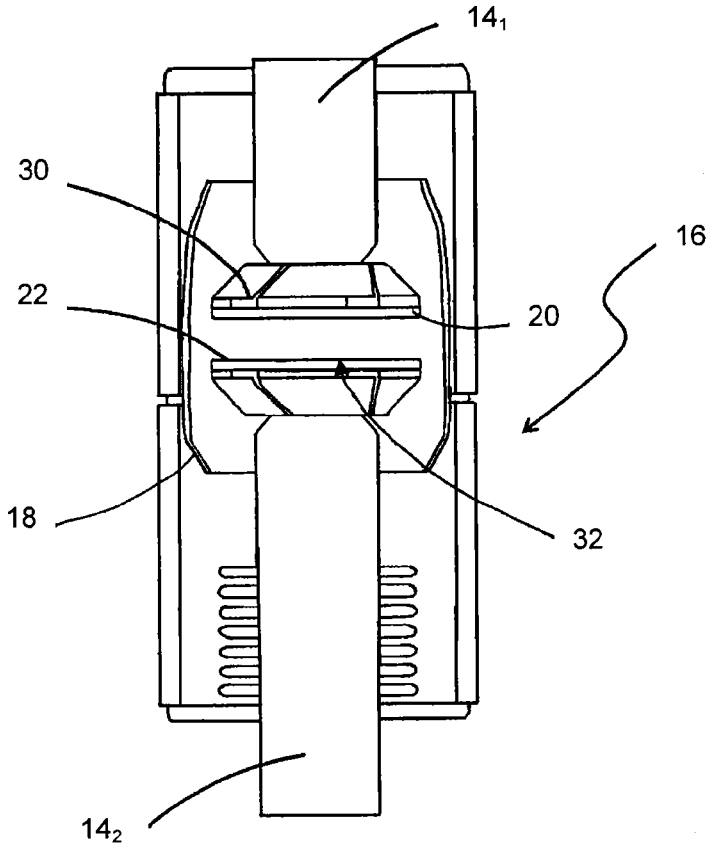
FIG. 2D illustrates a vacuum bulb according to one embodiment of the invention.
Figure 2B:
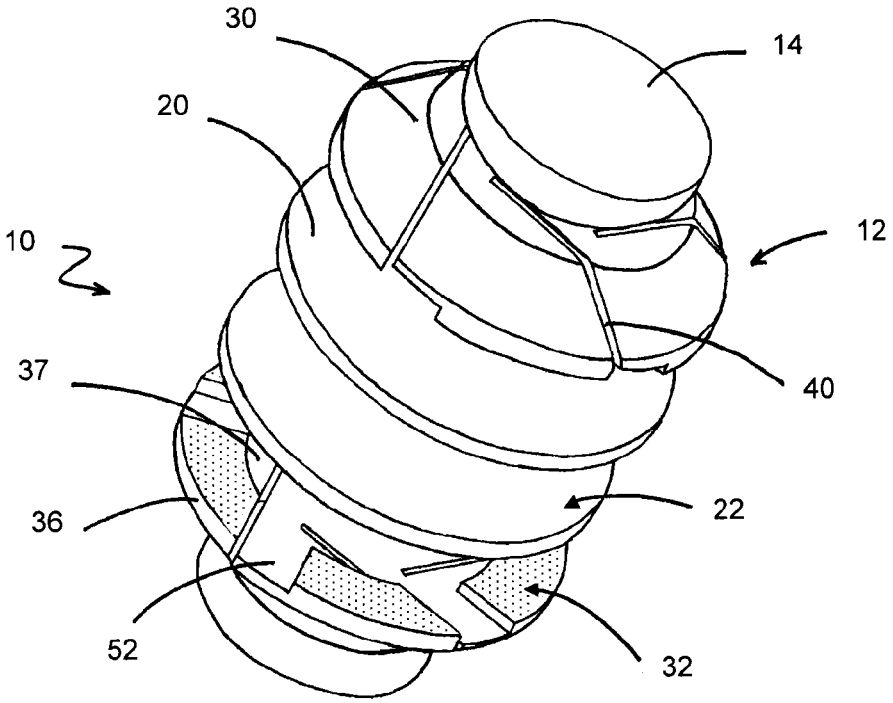
FIGS. 2B and 2C show a contact device according to one preferred embodiment of the invention, as an exploded view and in the assembled position.
Figure 2C:
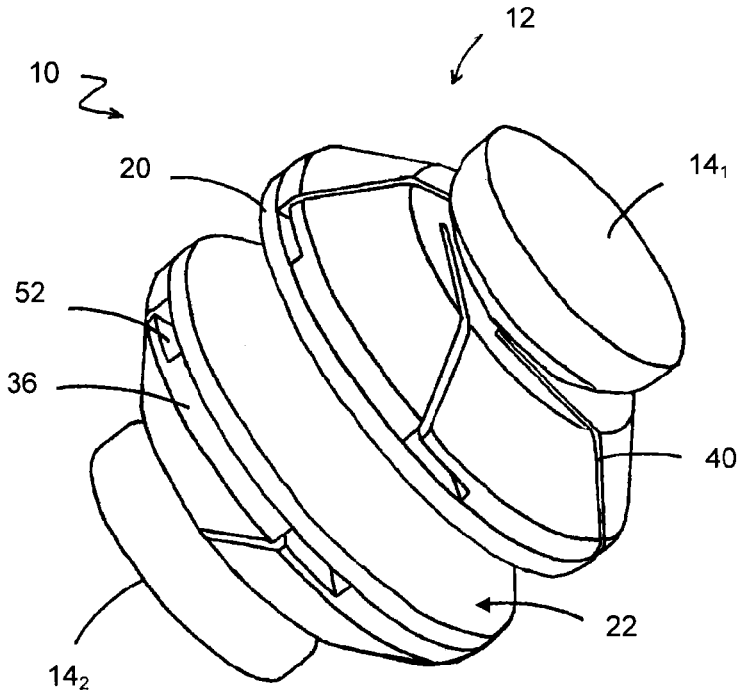

Thus, as illustrated in FIGS. 2B and 2C, the contact device 10 comprises two electrodes 12, commonly called "contacts", which are mirror images with respect to each other. The two electrodes 12 are mounted on two shafts 14 coupled to actuation means (not shown) so as to allow a relative movement between the two electrodes 12, said movement taking place by translation along the shaft 14. Usually, one of the shafts $\mathbf{14}_1$ is mounted static in the vacuum bulbs 16 and the other $\mathbf{14}_2$ is mobile in translation (FIG. 2D). When the device 10 is used in a vacuum bulb 16, it is placed within an insulating chamber, conventionally made of ceramic, often with a metal screen 18, made of copper or stainless steel for example, localized around the electrodes 12 irrespective of their relative position.

The electrodes 12 are of generally circular shape in order to better distribute the electric field lines; their diameter varies as a function of the fault current that the vacuum bulb 16 has to interrupt and re-establish, notably between 20 mm for fault currents less than 20 kA to greater than 140 mm for fault currents of the order of 100 kA or more.

Figure 3A:
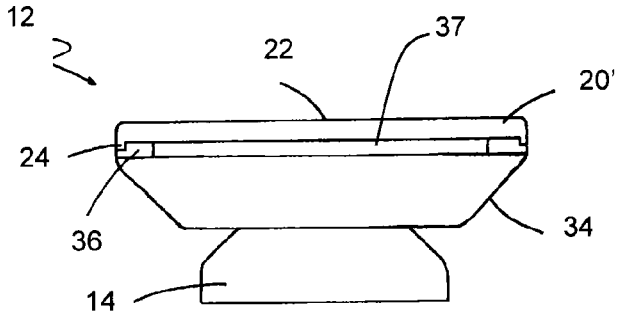
FIGS. 3A and 3B show installation alternatives of the tablet-shaped element on a base element in a device according to the invention.

Each electrode 12 is composed of a base element 30 made of a material with low resistivity, generally copper, and of a tablet-shaped contact 20 forming the contact surface between the two electrodes 12. According to the invention, the tablet-shaped element 20, sometimes also referred to as "contact tip", is a full disk, made of a conducting material conventionally used in this application, notably a copper/chrome or copper/tungsten alloy; the disk 20 could also be dished. Preferably, the contact surface 22 of the solid wafer 20 is flat, without having a particular profile, although it would be possible to add cut-outs; alternatively, such as illustrated in FIG. 3A, on its face opposite to the contact surface 22, the tablet-shaped element 20' could comprise a lip 24 which allows a protection of the support 30 against the effects of the arc, by covering its periphery. However, in fact, a complete and flat disk 20 without cut-outs, easy to manufacture and hence inexpensive, guarantees the best dielectric performance of the vacuum bulb 16 in which the contact device 10 will be installed.

Figure 3B:
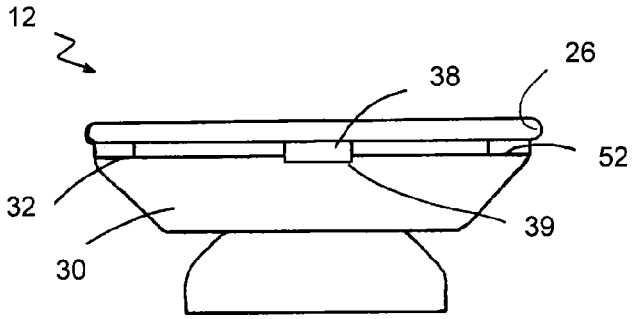

The thickness of the tablet-shaped element 20 can vary from one to a few millimeters depending on the level of fault current that the vacuum bulb 16 has to interrupt and/or to re-establish. The tablet-shaped element 20 can be the same size as the face of the support 30 to which it is rigidly attached. In one preferred embodiment illustrated in FIG. 3B, the diameter of the disk 20 is greater than that of the base 30, for example by of the order of its thickness, notably by 0.5 mm, 1 mm or 5 mm; the overhangs 26 may reach several times the thickness of the tablet-shaped element 20, in such a manner as extend the diffusion region of the arc.

Each tablet-shaped element 20 is therefore associated with a base element, or base 30, preferably by brazing. The base element 30 comprises a circular coupling surface 32, superposable onto the tablet-shaped element 20 or with a slightly smaller diameter; its general shape can be a disk, or a bowl, but preferably, the base element 30 has rounded edges 34 in order to guarantee good dielectric performance. The thickness of the base element 30 can be of the order of a few millimeters, up to around ten, depending on the nominal current that the bulb 16 has to continuously conduct.

The base element 30 is hollowed out at its center so as to leave a lip 36 on which the tablet-shaped element 20 rests. The depth of the hollow 37 is a few millimeters, advantageously 2 mm, which allows the electrical resistance to be minimized guaranteeing a good compensation in the case of crushing of the contacts during the hundreds, or even thousands, of operations carried out by a vacuum bulb 16. In order to stabilize the whole assembly, notably for large electrodes, a central reinforcement 38 may be installed in order to support the tablet-shaped element 20; the reinforcement 38 is preferably made of stainless steel and cylindrical; in one preferred embodiment illustrated in FIG. 3B, it is placed in a suitable fixture 39 of the base element 30.

Figure 5A:
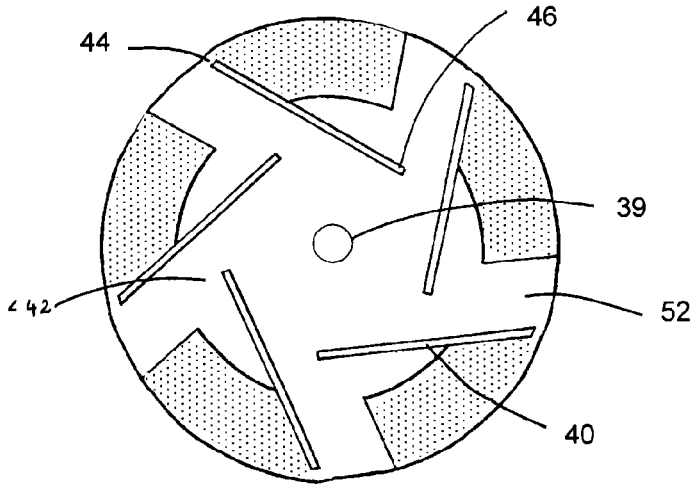
FIGS. 5A, 5B and 5C show alternatives for base elements of a device according to the invention.

The base element 30 comprises cut-outs 40 which force the paths of the lines of current during their passage from one electrode 12 to another. The cut-outs are slots 40 passing through the base 30 between its coupling surface 32 and the opposite face, so as to form sectors 42 of the base 30. The slots 40 extend between a first peripheral end 44, and a second central end 46; advantageously, the slots 40 are open-ended, in other words the first end 44 corresponds to the external wall of the base element 30. Alternatively, such as illustrated in FIG. 5A, the slots 40 are not open-ended, and the first ends 44 form a circle inscribed in the base element 30; the circle thus formed typically has a diameter of 1 to 2 mm, or even a few millimeters, less than that of the base element 30.

Figure 4:
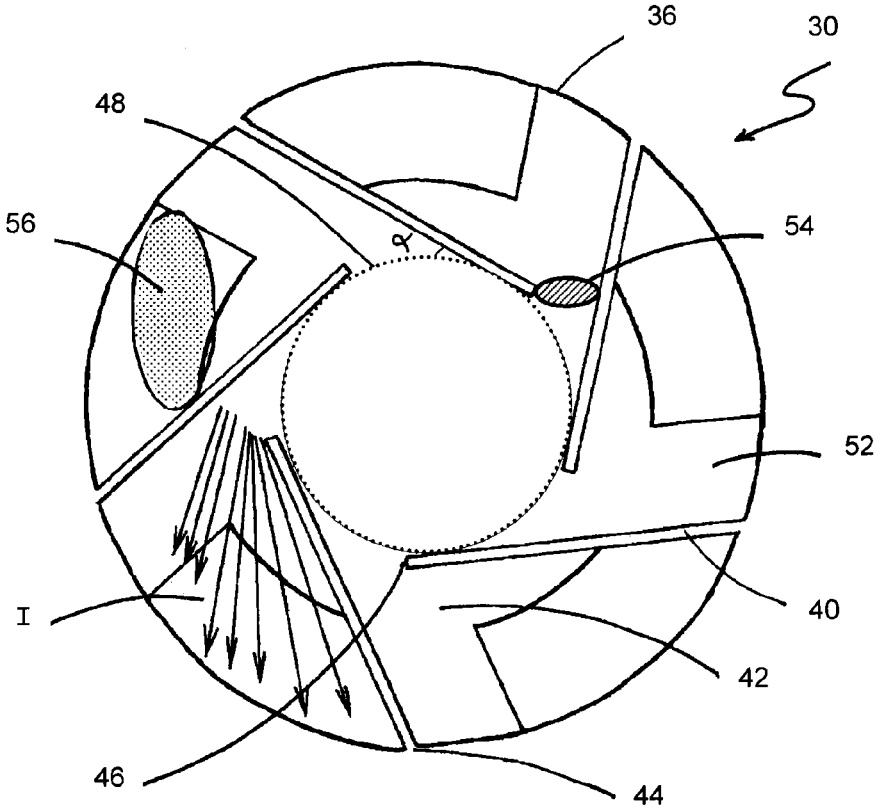
FIG. 4 illustrates the action on the lines of current of a base element for a device according to the invention.

Such as illustrated in FIG. 4, the direction of the lines of current I depends on the orientation of the cut-outs 40: in order to flow between the two electrodes 12, the current I must go from the center of the base element 30 to its periphery on the cathode, and vice versa on the anode, within the volumes defined by the cut-outs 40. The slots 40 are arranged so as to be tangent at their second end 46 to a circle 48 centered with respect to the base element 30. The angle $\alpha$ thereby defined between the slot 40 and the circle 48 is preferably identical for all the slots 40 in the base element 30, but anyway, the angles $\alpha$ are always in the same direction, in other words the sectors 42 are increasing in size from the center towards the periphery, the size being measured along the arc of a circle centered on the base element 30/the shaft 14. Advantageously, the slots 40 are superposable and/or distributed in a uniform manner around said circle 48, the slots 40 differing from one another solely by a rotation about the center of the base element 30, advantageously by a constant angle.

The width of the cut-outs 40 is sufficient to allow the separation of the regions in which the lines of current I are flowing, which gives them their paths and controls their density depending whether they are near to the center or to the periphery of the base element 30, while at the same time remaining limited in order to keep the base element 30 stable; preferably, the slots 40 are of the order of 1 mm in width. Similarly, at least three slots are shown, but increasing their number allows the paths of the lines of current to be optimized when they pass through the base element 30. In order to remain within limits of cost-effectiveness and mechanically advantageous, it is preferable to include five or six slots 40.

Figure 5B:
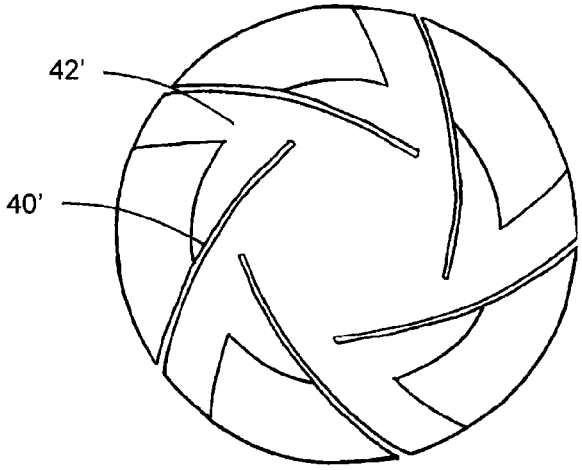

The slots 40 may be linear for manufacturing reasons. Alternatively, such as illustrated in FIG. 5B, the slots 40' can be curved so as to form sectors 42' in the form of petals, or in the form of propellers, preferably superposable, in order to amplify the rotation of the diffuse arc.

In order to force the paths of the lines of current I and to cause the rotation and the acceleration of the arc, it is advantageous to additionally provide recesses 52 in the brazing lip 36: thus, such as illustrated in FIG. 4, the lines of current I get concentrated onto an edge part of the recess 50, in the lip 36. The width of the recesses 52 is adapted to the base element 30 in such a manner as to ensure sufficient electrical conduction between the two parts 20, 30 of the electrode 12, while at the same time causing a rotation and a better acceleration of the arc. Preferably, the recesses 52 are identical for all the sectors 42 and represent around a quarter to a half of the lip 36.

Figure 5C:
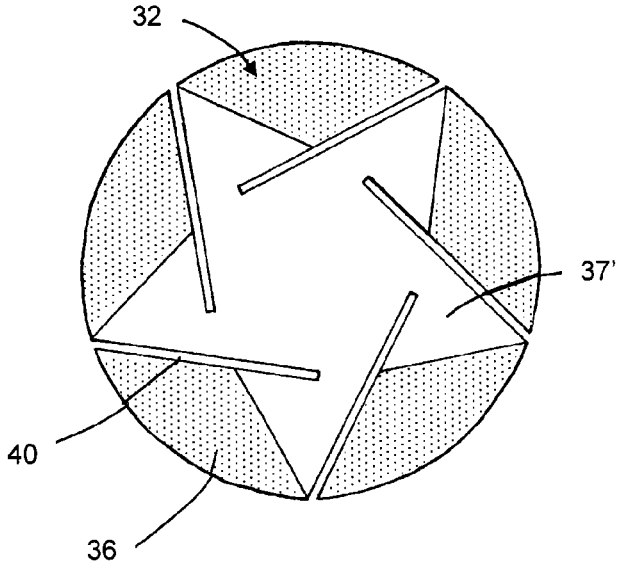

Alternatively, such as shown schematically in FIG. 5C, the lip 36 is substantially closed over its periphery, with the exception of the open-ended slots 40. In this embodiment, the rotation is provided by an appropriate shape of the central hollow 37', which is no longer circular but comprises sharp angles, said angles being in part bounded by the slots 40. This alternative allows a larger coupling surface 32 to be obtained, and offers a substantially equal path to all the lines of current I.

The shape of the sectors 42, narrow toward the central region and broadening toward the periphery, leads to dense lines of current I near to the center, with a region of concentration 54, which spread out increasingly as they move toward the periphery so as to minimize the current density in a region of divergence 56 and to occupy the whole available volume of the sectors 42 of the base element 30 within the hollow 37, an effect which optimizes the diffusion of the arc.

As stated hereinabove, the device 10 according to the invention comprises two electrodes 12 placed facing each other, with cut-outs 40 which are mirror images of each other, in order to obtain a radial field: the slots 40 are thus lined up with one another, only separated by the tablet-shaped elements 20. Thus, the lines of current I which flow inside the sectors 42 of the base element 30 create a magnetic field which generates a force which gives a rotational movement to the arc, in contrast to the RMF or TMF arc control, in which the current flows within the tablet-shaped element 20 so as to create the magnetic field which makes the arc rotate. The arc itself remains between the two tablet-shaped elements 20, diffuse over the whole surface: the macroscopic path of the current in the two parts of the arc control generates a magnetic field which imposes a rotational movement on the arc independently of the fact that it is diffused. In particular:

- the effect of rotation of the arc is obtained by the radial magnetic field created by the overall movement of the current within the structure of the base element 30;
- the effect of diffusion of the arc is obtained by forcing the lines of current to follow defined paths with a high current density. When the current leaves the shaft $\mathbf{14}_1$ of the bulb for the cathode, it flows from the center of the base element towards its periphery—and passes through the region 54 which offers little material for the lines of current I; at the periphery of the base of the cathode, the lines of current I pass through a more extensive volume of material, and are dispersed by occupying the available volume before passing into the arc which has been formed between the two contacts, then to the second contact (anode) so as to complete the journey in the reverse direction toward the shaft $\mathbf{14}_2$ of the bulb.

Several tests have been carried out. In particular, in a vacuum chamber simulating a vacuum bulb, filmed images and the measurement of its voltage (across terminals of the two contacts in the presence of the arc) have shown that the arc was effectively diffuse and endowed with a rotational movement.

Figure 6:
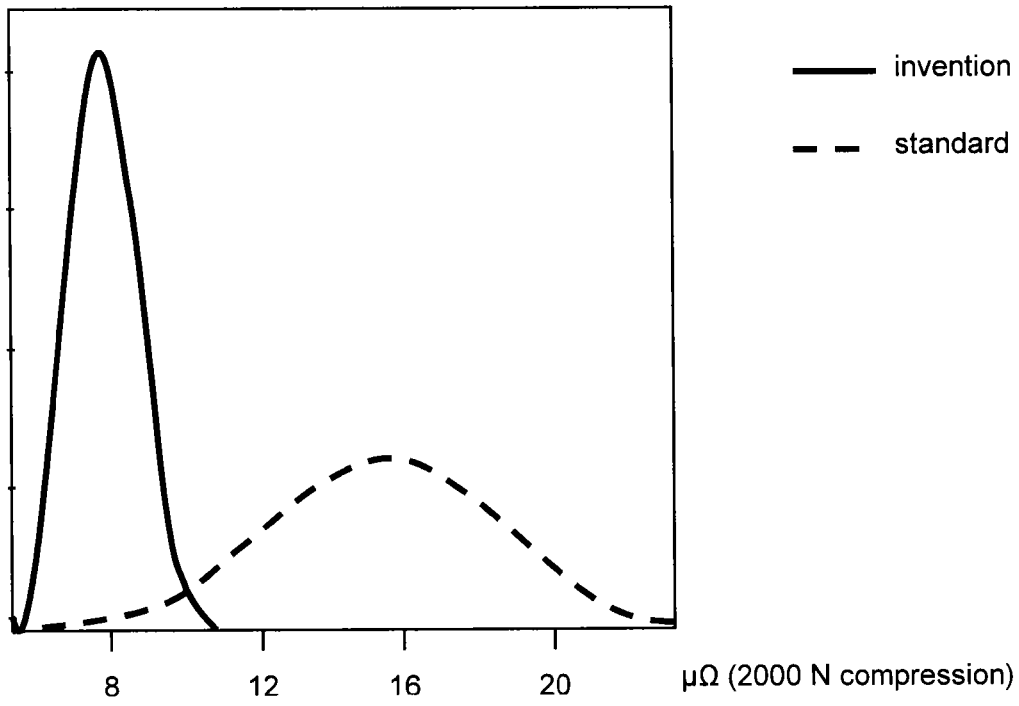
FIG. 6 shows the dispersion in the measurement of electrical resistance in a commercial bulb equipped with a device according to the invention and with a conventional device.

In addition, the contact device 10 illustrated in FIG. 2C has been used in place of an existing contact device in vacuum bulbs of the VG type marketed by Schneider Electric: for the same dimensions (arc control of 60 mm with a disconnection rating of 31.5 kA at 17.5 kV), the vacuum bulb allows fault currents to be interrupted that are up to 20% higher than the maximum currents that a standard bulb can interrupt. Moreover, such as shown in the FIG. 6, the electrical resistance of the bulbs with the new arc control, allowed by the device according to the invention, is lower (a mean value reduced by two in the example illustrated), in other words the heating of the poles of circuit breakers, proportional to said electrical resistance, is limited; it is also noted that the dispersion of the measurements is lower, with notably a standard deviation less than 1 for a mean value of the resistance of around 7.8μΩ compared with a standard deviation greater than 3 for a mean value of the resistance of around 15.3μΩ.

Thanks to the novel type of contact device 10 according to the invention and to the arc control according to the diffuse arc concept, non-contracted, but in rotation that it enables to be applied, the switchgear equipment and vacuum bulbs 16 offer the following advantages:

- an efficient distribution of the thermal energy which allows the demands of particular applications to be satisfied, such as those with very long arc times, like the delayed zero in the disconnections of alternators, certain railroad applications with frequencies of 16 Hz, etc.;
- a high disconnection rating, identical to that of an arc control of the RMF or TMF type;
- a good performance for current interruptions with long arc times;
- high and constant dielectric performance characteristics before and after a fault current disconnection;
- an electrical longevity by virtue of the full contact surfaces 22;
- prevention of welding phenomena during closing operations, owing to the fact that the energy of rotation of the arc 9 upon its creation (distance between the two contacts less than a millimeter) gets distributed over a surface 22;
- very good performance characteristics for disconnection of banks of capacitors owing to the good dielectric breakdown performance and to the rotation of the pre-arc during closing onto capacitor bank currents that can reach 20 kA or more;
- a low electrical resistance;
- a controlled localization of the arc which remains inside the contact surface 22, and does not latch onto the screen 18 of the vacuum bulb 16;
- a better mechanical resistance of the contact device 10 than that of the AMF or RMF/TMF types;
- a cost of fabrication of the tablet-shaped contact 20 lower than that used for a TMF arc control of the petal type, and especially for an arc control of the AMF type.

The invention claimed is:

1. A contact device for a vacuum bulb, the contact device comprising:

- two electrodes each rigidly attached to a respective shaft, the shafts being axially aligned with each other, each electrode comprising a tablet-shaped element associated with a base element via a coupling surface, the two electrodes configured to take a position in which the tablet-shaped elements are in contact and a position in which they are separated from one another by a relative translation along the shafts;
- wherein the coupling surface comprises cut-outs extending between a first end at a periphery of the base element and a second end internal to the base element, each cut-out being tangent to a circle centered on the respective shaft at the second end;
- wherein the cut-outs pass through a thickness of the base element, the cut-outs of a base element are all in a same direction to form sectors of an arc base element broadening from a center toward the periphery, and the two electrodes are a mirror image of each other, such that the cut-outs are superposed in the contact device; and
- wherein each base element includes a peripheral lip to couple with the tablet-shaped element, each lip comprising at least one recess adjacent to at least one cut-out.

2. The contact device according to claim 1, wherein the tablet-shaped element is a substantially plane full disk.

3. The contact device according to claim 2, wherein the coupling surface is included in a circle inscribed within the disk of the tablet-shaped element.

4. The contact device according to claim 1, wherein each base element comprises a central hollow, forming the peripheral lip that couples with the tablet-shaped element.

5. The contact device according to claim 4, wherein each electrode further comprises a reinforcement within the hollow for supporting the tablet-shaped element.

6. The contact device according to claim 4, wherein each lip comprises the at least one recess in an extension of the hollow and opening onto the periphery.

7. The contact device according to claim 6, wherein the coupling surface comprises five portions of a lip ring separated by five recesses and bounded at one end by a cut-out.

8. The contact device according to claim 4, wherein the tablet-shaped element is a substantially plane full disk and the coupling surface is included in a circle inscribed within the disk of the tablet-shaped element.

9. The contact device according to claim 7, wherein the tablet-shaped element is a substantially plane full disk and the coupling surface is included in a circle inscribed within the disk of the tablet-shaped element, and each electrode further comprises a reinforcement within the hollow for supporting the tablet-shaped element.

10. The contact device according to claim 1, wherein the cut-outs are slots opening out at their first end.

11. The contact device according to claim 1, wherein the cut-outs are identical, offset from one another by rotation around the shaft.

12. The contact device according to claim 11, wherein the cut-outs and sectors are distributed uniformly around the shaft.

13. The contact device according to claim 8, wherein the cut-outs are identical slots opening out at their first end and offset from one another by rotation around the shaft, so that the cut-outs and sectors are distributed uniformly around the shaft.

14. A vacuum bulb comprising an air-tight chamber in which a contact device according to claim 1 is positioned, at least one of the shafts of the device being associated with an actuation mechanism allowing the tablet-shaped elements to take the two positions.

15. A switchgear device comprising a vacuum bulb as claimed in claim 14.

16. A vacuum bulb comprising:

an air-tight chamber in which a contact device comprising two electrodes is positioned, each electrode being rigidly attached to a respective shaft, the shafts being axially aligned with each other, each electrode comprising a tablet-shaped element associated with a base element via a coupling surface, the two electrodes configured to take a position in which the tablet-shaped elements are in contact and a position in which they are separated from one another by a relative translation along the shafts;

wherein the coupling surface comprises cut-outs extending between a first end at a periphery of the base element and a second end internal to the base element, each cut-out being tangent to a circle centered on the respective shaft at the second end;

wherein the cut-outs pass through a thickness of the base element, the cut-outs of a base element are all in a same direction to form sectors of an arc base element broadening from a center toward the periphery, and the two electrodes are a mirror image of each other, such that the cut-outs are superposed in the contact device; and wherein each base element includes a peripheral lip to couple with the tablet-shaped element, each lip comprising at least one recess adjacent to at least one cut-out.

17. The vacuum bulb according to claim 16, wherein the tablet-shaped element is a substantially plane full disk and the coupling surface is included in a circle inscribed within the disk of the tablet-shaped element.

* * * * *